United States Patent [19]

Aidar

[11] 4,403,817

[45] Sep. 13, 1983

[54] DRAWER FOR FURNITURE

[75] Inventor: Fernando H. Aidar, Sao Paulo, Brazil

[73] Assignee: Eucatex S.A. Industria é Comercio, Sao Paulo, Brazil

[21] Appl. No.: 246,326

[22] Filed: Mar. 23, 1981

[30] Foreign Application Priority Data

Mar. 31, 1980 [BR] Brazil ..... 6000363

[51] Int. Cl.[3] ..... A47B 88/00

[52] U.S. Cl. ..... 312/330 R; 312/330 SM

[58] Field of Search ..... 312/330 R, 330 SM, 341 R, 312/341 NR, 349, 334, 335, 263, 107, 111

[56] References Cited

U.S. PATENT DOCUMENTS

| | | | |
|---|---|---|---|
| 1,627,084 | 5/1927 | Fritz | 312/107 |
| 2,701,174 | 2/1955 | Franks | 312/330 R |
| 3,159,436 | 12/1964 | Davis | 312/107 |
| 3,315,834 | 4/1967 | Nemlich | 312/330 R |
| 3,511,550 | 5/1970 | Hilfinger et al. | 312/330 R |
| 3,610,719 | 10/1971 | Alston | 312/330 R |
| 3,744,869 | 7/1973 | Anderson et al. | 312/330 R |
| 3,933,401 | 1/1976 | Lampe et al. | 312/330 SM |
| 3,967,870 | 7/1976 | Noneman et al. | 312/330 SM |
| 4,042,288 | 8/1977 | Litchfield | 312/330 R |
| 4,099,815 | 7/1978 | Cox et al. | 312/330 R |

FOREIGN PATENT DOCUMENTS

| | | | |
|---|---|---|---|
| 1085624 | 10/1967 | United Kingdom | 312/330 SM |
| 1341399 | 12/1973 | United Kingdom | 312/330 R |

*Primary Examiner*—Victor N. Sakran

*Attorney, Agent, or Firm*—Eugene D. Farley

[57] ABSTRACT

A furniture drawer comprises side and rear walls made of profile material laid out in its upper and lower extremities with folds for fitting in and sliding the drawer in relationship to the furniture, and, in at least one of its extremities, with a cutaway at right angles, for fixing the front or rear walls of same.

6 Claims, 5 Drawing Figures

DRAWER FOR FURNITURE

This invention relates to drawers for furniture. It has for its general purpose the provision of a furniture drawer which can be shipped and stored in knock-down condition preliminary to being assembled on the job site; which can be assembled by unskilled labor; which is fabricated from components which nest for convenient storage and shipping; which after assembly and installation will maintain satisfactory performance over a long operating period.

In the drawings

Figure 1:
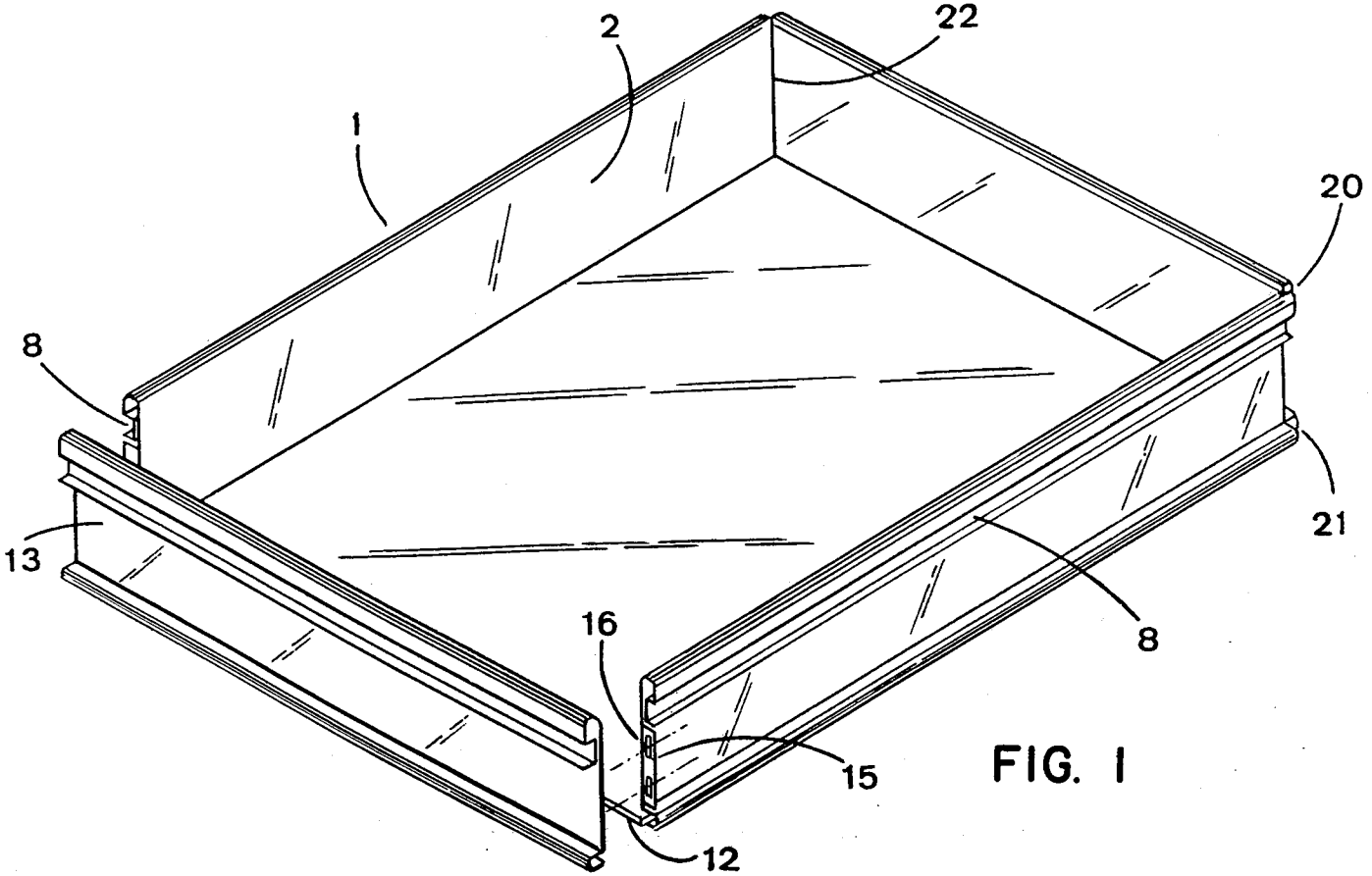
FIG. 1 is a top perspective view, partly exploded, of the furniture drawer of the invention in a first embodiment.

As shown in the drawings, the drawer of my invention has its outlining walls in the form of a profile Part 1 made of rolled sheet steel or other suitable structural material; The vertical wall, 2, of a certain height, revealing at the top a curvature outwards, 3, then going down vertically in the form of a slight prolongation, 4, and then going horizontally inwards, 5, and then vertically downwards, 6, and finally, horizontally outwards, 7, forming a quadrangular recess, 8, of adequate height and depth, appropriate for serving as a guide to support and move the drawer in relationship with the furniture. The said profile part presents, below, a horizontal fold outwards, 9, followed by a slight curvature, 10, downwards and then inwards and upwards, making up, in its turn, a small recess, 11, for fitting in, in order to slide the bottom, 12, of the drawer.

Figure 2:
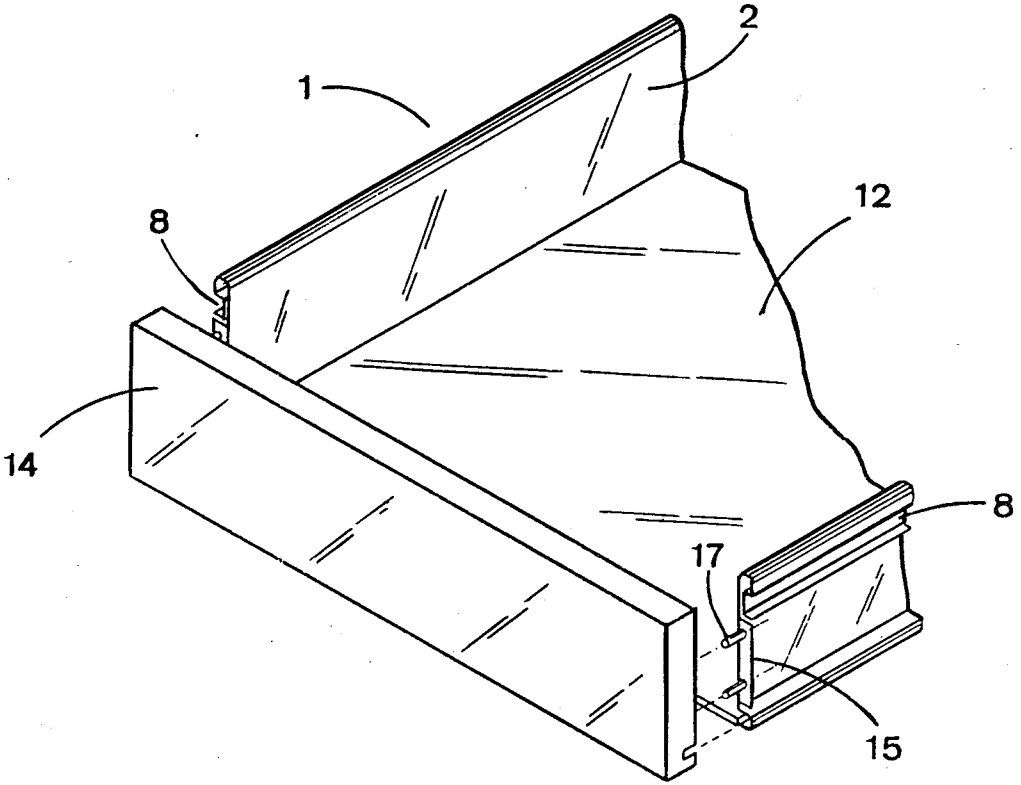
FIG. 2 is a fragmentary, partly exploded, view of the furniture drawer of the invention in a second embodiment.

The front wall of the drawer can be made up of a segment, 13, of this same profile part, or by a simple plate of wood, 14, or of some other material, as may be seen respectively in FIGS. 1 and 2, in a perspective view.

Figure 3:
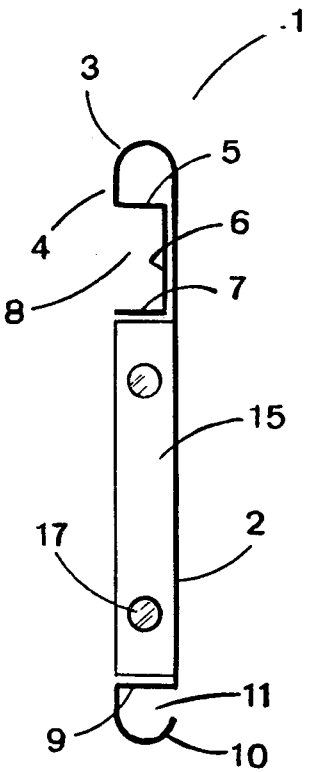
FIG. 3 is a view in end elevation of one of the walls of the drawers of FIGS. 1 and 2.

The extremity facing the profile part has, in any case, a small cutaway, 15, folded outwards in a right angle, forming a rim or flap, as illustrated in FIGS. 1 and 2 in detail in FIG. 3, in a front view, laid out with little openings, 16, or pins, 17, for fixing on the front wall of the drawer.

A practical advantage of using the profile part itself in making up the front part of the drawer is in the fact of saving an additional puller, considering that the quadrangular recess, 8, can supply this function.

Figure 4:
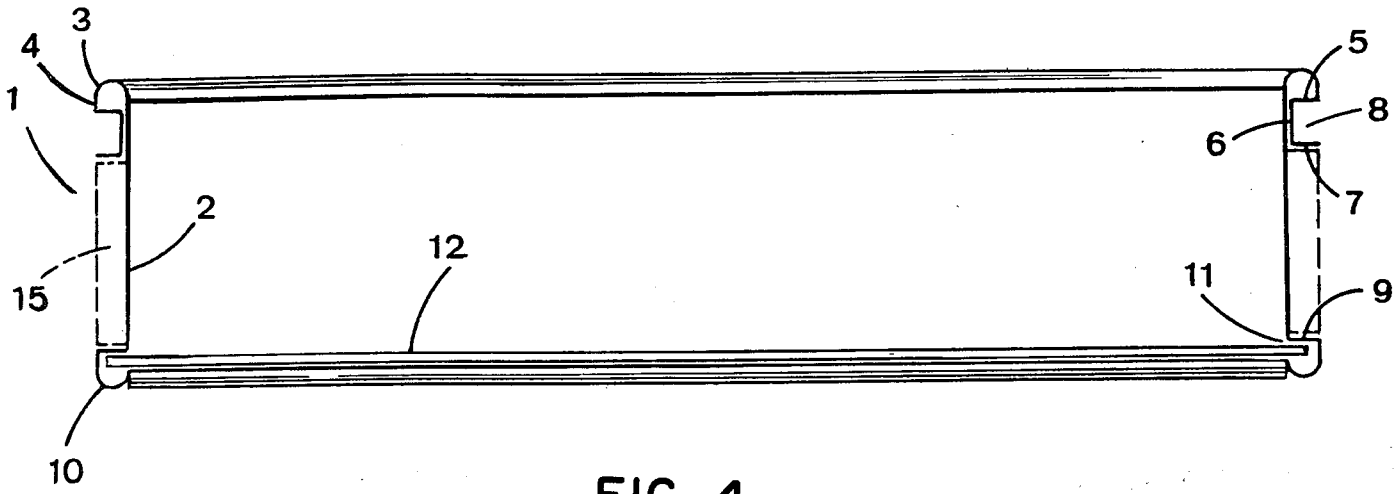
FIG. 4 is a view in front elevation of the drawer, with the front panel removed.
Figure 5:
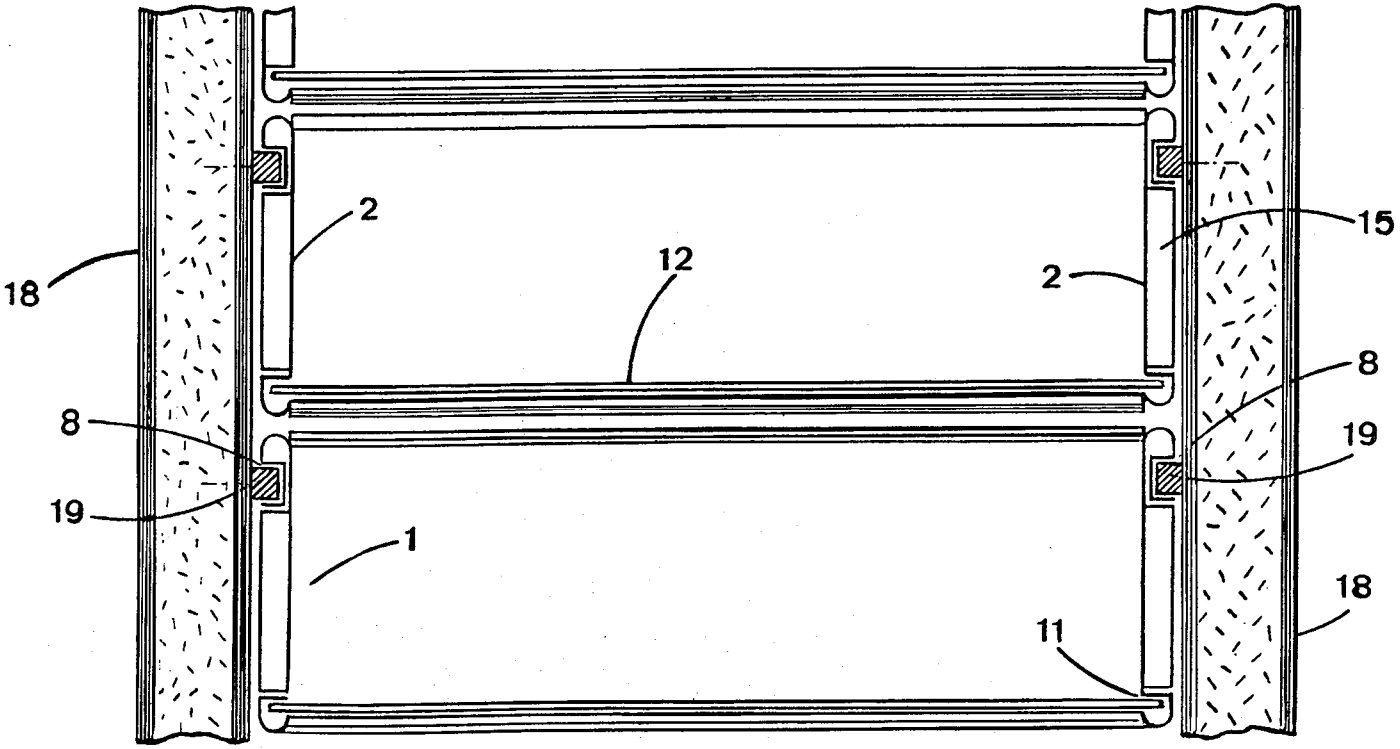
FIG. 5 is a view in front elevation, partly in section, of a drawer assembly comprising a plurality of the drawers of the invention in operative position with their front panels removed.

FIG. 4 represents the drawer in a front view, in a cross-section, and, in dotted lines, one may see the rim or flap, 15, fixed on the front wall of the drawer. FIG. 5 repeats the foregoing representation, and the drawer is seen in a plural number, duly conjugated to the furniture, 18, to wit: with the quadrangular recess, 8, serving as support and movement for the drawer along the horizontal rails, 19, which already existed in the furniture. In this FIG. 5, the rims or flaps 15 are seen in full lines, and the drawer is represented illustratively without the front wall 13 or 14, to give a better view of the fitting in of the rails, 19, of the furniture in the quadrangular recess, 8, of the drawer.

The constructive layout, as described above, allows the drawer to be made simply and quickly, for its surrounding walls, on the sides and rear, can be made out of a single body of profile material, simply cut at its upper edge, 20, and lower edge, 21, and folded at a right angle in its vertical wall to form the corners, 22, (FIG. 1) although it may also be used in assembling the rear wall, the same system of rims or flaps, 15, adopted for the front part of the drawer.

This utility model having thus been described, its fundamental characteristics consist of what is contained in the enclosed claims, which make up an integral part of this report and complement it.

I claim:

1. A drawer for furniture, comprising:

(a) side and rear vertical walls each formed of sheet metal having an intermediate vertical wall portion, a bottom portion extending perpendicularly outward from the bottom end of the vertical wall portion and thence downward, inward and upward, terminating a spaced distance below the bottom end of the vertical wall portion to provide therebetween an inwardly facing recess for reception of a drawer bottom, and a top portion extending outward and downward from the upper end of vertical wall portion, thence inward, downward and outward to provide an outwardly facing recess for reception of a drawer support rail in said recess of each side wall, (b) a drawer bottom retained in said inwardly facing recesses, and (c) a front wall secured to the front ends of said side walls.

2. The drawer of claim 1 including a flap extending perpendicularly outward from the front ends of the vertical wall portions of the side walls, and means on said flaps for securing the front wall thereto.

3. The drawer of claim 2 wherein the securing means on said flaps include forwardly projecting pins.

4. The drawer of claim 2 wherein the securing means on said flaps include openings through said flaps.

5. The drawer of claim 1 wherein said side and rear walls are formed of a single length of sheet metal, the bottom and top portions being cut through their vertical lengths at positions defining the opposite ends of the rear wall of the drawer and the intermediate vertical wall portion being bent vertically in line with said cuts to right angles to form the side walls extending perpendicularly forward from the opposite ends of the rear wall.

6. The drawer of claim 1 wherein the front wall is a length of sheet metal formed in the same shape as the side and rear walls, the outwardly facing recess in the front wall serving as a drawer pull.

* * * * *